United States Patent [19]

Hirose

[11] 4,348,786

[45] Sep. 14, 1982

[54] OPENING AND CLOSING APPARATUS

[75] Inventor: Akira Hirose, Tokyo, Japan

[73] Assignee: Ricoh Co., Ltd., Tokyo, Japan

[21] Appl. No.: 80,791

[22] Filed: Sep. 28, 1979

[30] Foreign Application Priority Data

Oct. 18, 1978 [JP] Japan ..... 53/127998

[51] Int. Cl.[3] ..... E05F 1/12; E05F 5/00

[52] U.S. Cl. ..... 16/75; 16/308

[58] Field of Search ..... 16/50, 67, 63, 75, 76, 16/184

[56] References Cited

U.S. PATENT DOCUMENTS

| | | | |
|---|---|---|---|
| 1,612,237 | 12/1926 | Thoruton | 16/50 |
| 2,733,476 | 2/1956 | Eck | 16/184 X |
| 3,022,536 | 2/1962 | Floehr | 16/75 |
| 3,209,391 | 10/1965 | Mangini | 16/184 |
| 3,490,756 | 1/1970 | Spier | 16/75 X |

*Primary Examiner*—Andrew V. Kundrat

*Attorney, Agent, or Firm*—Wyatt, Gerber, Shoup, Scobey & Badie

[57] ABSTRACT

An opening and closing apparatus comprises a swingable member, spring means and resilient restoring force transmission means for transmitting the resilient restoring force of the spring.

The swingable member is supported pivotally by the support means so as to be opened and closed with respect to a base frame of the swingable member, and one end of the spring means is fixed to a support portion on which one end portion of the swingable member is pivotally supported, and the other end of the spring means can be twisted forcibly in the closing direction of the swingable member. The resilient restoring force of the twisted end of the spring means is transmitted to or near the line of the center of the gravity of the swingable member, so that the opening and closing operation of the swingable member can be performed safely and smoothly.

6 Claims, 4 Drawing Figures

OPENING AND CLOSING APPARATUS

BACKGROUND OF THE INVENTION

The present invention relates to an opening and closing apparatus for opening and closing a swingable member or apparatus, such as an automatic document feeder attached to a copying machine.

For use with electrophotographic copying machines or the like, such an automatic document feeder has been proposed which is disposed in an upper portion of the body of a copying machine, and when copies are made from sheet-like originals, the automatic document feeder is closed and the sheet-like originals are fed automatically, and when copies are made from a book or the like, the automatic document feeder is opened so that the book can be directly placed on a contact glass. Referring to FIG. 1, there is shown an example of such an automatic document feeder which is mounted on an upper portion of the body of a copying machine. When an original is inserted into an outlet portion 2 of the automatic document feeder 1, the original is transported onto a contact glass 6 by a sheet transport belt 5 trained over a pair of pulleys 3 and 4. The original is illuminated while it is stopped temporarily or moved continuously. The original is then discharged out of the automatic document feeder 1 through a pair of sheet discharge rollers 7. A base portion of the automatic document feeder 1 is pivotally attached to a shaft 10 of a support frame portion 8 of the body of the copying machine, so that the automatic document feeder 1 can be opened by being swung about the shaft 10. When copies are made from a book or the like, the automatic document feeder 1 is swung open as shown in FIG. 2, and the book is placed directly on the contact glass 6.

Since such an automatic document feeder includes an original sheet transportation mechanism and a drive motor and other devices, the automatic document feeder itself is typically heavy and substantial force is required to open the automatic document feeder so that it has a shortcoming of lacking for the highest safety in operation.

SUMMARY OF THE INVENTION

It is therefore an object of the present invention to provide an opening and closing apparatus for opening and closing a swingable member or apparatus, such as automatic document feeder or the like, with the above-mentioned shortcoming eliminated therefrom.

According to the present invention, a swingable member is supported pivotally by support means so as to be opened and closed with respect to a base frame of the swingable member, and one end of a spring means is fixed to a support portion on which one end portion of the swingable member is pivotally supported, and the other end of the spring means can be twisted forcibly in the closing direction of the swingable member. The resilient restoring force of the twisted end of the spring means is transmitted to or near the line of the center of the gravity of the swingable member.

According to the present invention, the opening and closing operation of the swingable member can be performed safely and smoothly.

DETAILED DESCRIPTION OF THE PREFERRED EMBODIMENT

Figure 3:
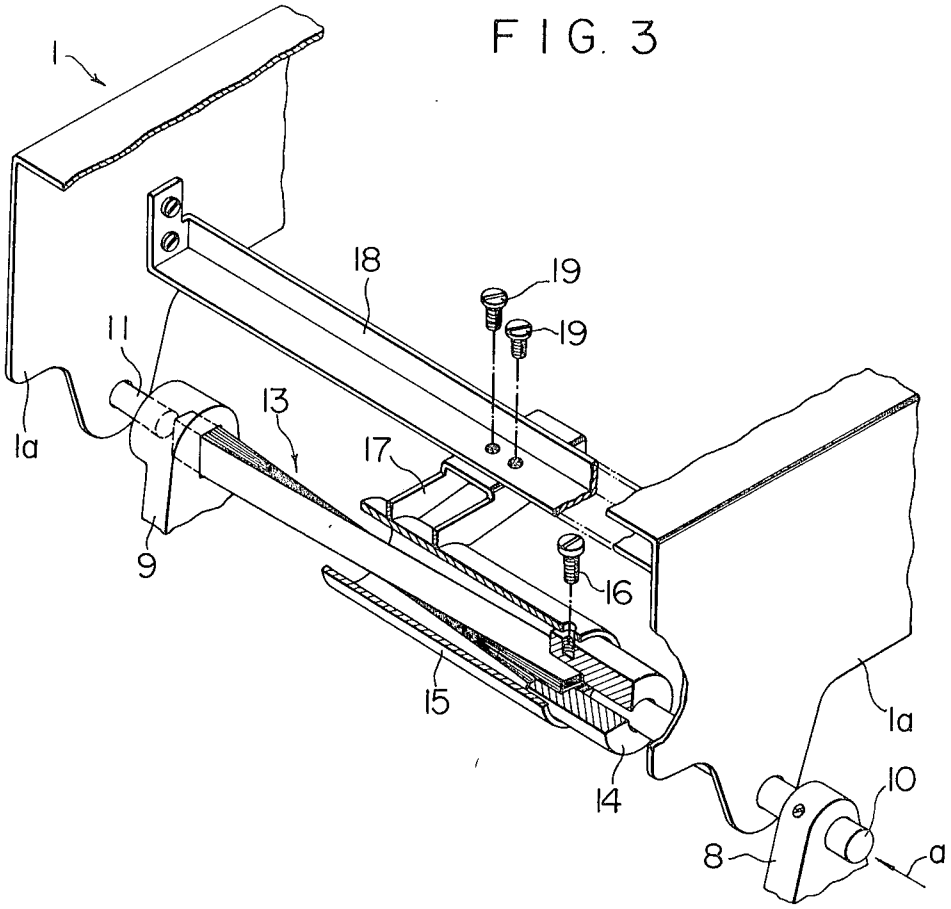
FIG. 3 is a schematic perspective view of an embodiment of an opening and closing apparatus according to the invention.

Referring to FIG. 3, there is shown an embodiment of an opening and closing apparatus according to the invention. In FIG. 3, base end portions of outer frame plates 1*a* of an automatic document feeder 1 are rotatably supported on shafts 10 and 11 which are fixed to support frame portions 8 and 9 of the body of the automatic document feeder 1. Into one support frame portion 9, there is tightly fitted one end of a spring member 13 comprising a plurality of superimposed thin and narrow spring plates, while the other end of the spring member 13 is tightly fitted into a support cylinder 14 which is fitted into the shaft 10.

Figure 1:
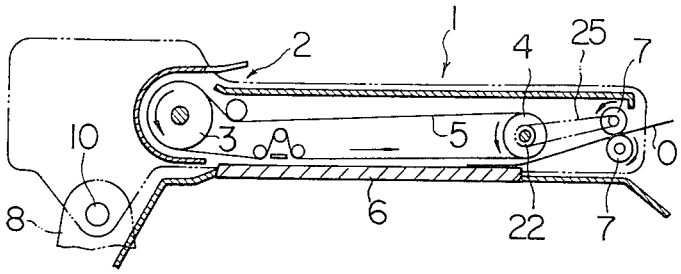
FIG. 1 is a schematic sectional view of an automatic document feeder for use with a copying machine, in which the present invention is employed.

One end portion of a cylindrical collar 15 is fixed to the support cylinder 14 by a screw 16, and one end of a support member or arm 17 is fixed to the peripheral surface of the cylindrical collar 15. Furthermore, a channel plate member 18, bridging the outer frame plates 1*a*, is fixed to an upper end of the support member 17 by screws 19. The support member 17 is set along a line which is in the vertical plane containing the center of gravity of the automatic document feeder 1. One end of the spring member 13, which is fixed to the support frame portion 9, is fixed, with its flat side set vertically, while the other end of the plate spring member 13, which is fixed to the support cylinder 14, is fixed with its flat side set horizontally. In other words, the plate spring 13 is forcibly twisted by approximately 90°, when viewed from the arrow a, with a neutral line in the longitudinal direction of the spring member 13 being a neutral position of the plate spring 13. In this state, the automatic document feeder 1 is in the closing position as shown in FIG. 1. In this condition, the self resilient restoring force of the plate spring 13 is transmitted along the line containing the center of the gravity of the automatic document feeder 1 through the support cylinder 14, the cylindrical collar 15, the support member 17 and other members, so that the self resilient restoring force of the spring member 13 and the weight of the automatic document feeder 1 are almost balanced with each other.

Figure 2:
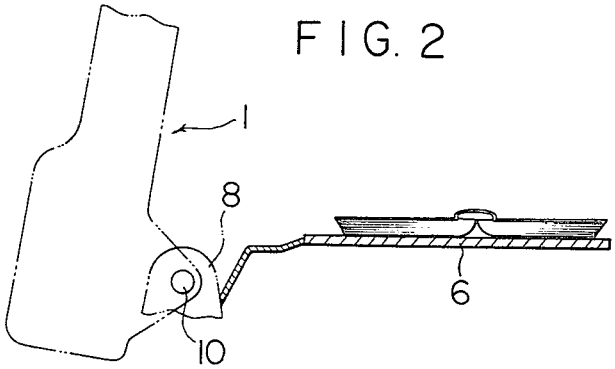
FIG. 2 shows the state when the automatic document feeder of FIG. 1 is opened.

Under this condition, the automatic document feeder 1 can be locked, when necessary, by an appropriate lock means. When the automatic document feeder 1 is released from the locking state and the free end side of the automatic document feeder 1 is manually lifted upwards so as to position the automatic document feeder 1 in the position as shown in FIG. 2, the automatic document feeder 1 can be opened by an extremely small force due to the self resilient restoring force of the other end of the spring member 13. When opening the automatic document feeder 1, the support cylinder 14 is rotated counterclockwise with respect to the shaft 10, viewed from the arrow a. At the same time, the support member 17 and the channel plate 18 and other members are also rotated counterclockwise about the axis of the shafts 10 and 11. In the above-mentioned embodiment, the resilient restoring force of the plate spring 13 can be adjusted by changing the number of spring plates. Instead of the spring plates, a coil spring can be employed by fixing one end of the coil spring to the support frame 9 and the other of the coil spring to the support cylinder 14 in a manner that the coil spring can be twisted.

Referring to FIG. 3, by disposing a friction mechanism between a base end portion of the two outer frames 1*a* and the shafts 10 and 11, the automatic document feeder 1 can be stopped at a desired position. In combination with such friction mechanism, the opening operation of the automatic document feeder 1 can be made easy and at the same time, the automatic document feeder 1 can be stopped at a desired opening angle.

In the invention, when a swingable member that opens and closes, such as the automatic document feeder, is closed, the closing operation is performed against the resilience of the plate spring 13 or of the coil spring. Therefore, it can be prevented that the swingable member, such as the automatic document feeder, is abruptly closed due to the gravity of the free end portion of the swingable member. This is a great safety advantage.

Furthermore, since the resilient restoring forces of the plate spring member 13 and the other members are transmitted through the cylindrical collar 15 and other members which are extended over the line including the center of the gravity of the automatic document feeder 1, the length of the spring member 13 can be set at a maximum length between the outer frame plates 1*a*. Furthermore, since the point of application of the resilient restoring force is on the line including the center of the gravity, there is no risk that the automatic document feeder 1 itself may twist. In the above-mentioned embodiment of the invention, the automatic document feeder is employed as the swingable member that opens and closes. However, the application of the invention is not limited to an automatic document feeder, but the invention can be applied to an original sheet holding plate or pressure plate of copying machines, a copying machine of the type whose upper unit comprising a photoconductor drum, an image fixing apparatus, an optical system and others can be opened, and to facsimile apparatus whose upper unit portion can be opened.

Figure 4:
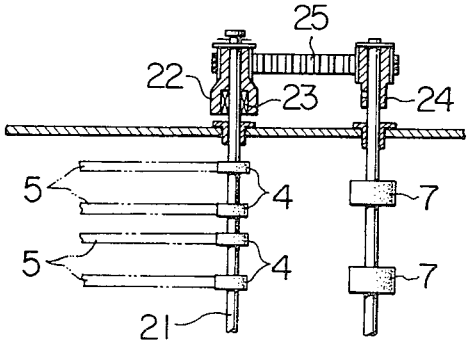
FIG. 4 is a schematic partial plan of an original transportation system of the automatic document feeder of FIG. 1.

In the automatic document feeder as shown in FIG. 1, in which the invention is employed, when an original O is transported from the sheet transport belt 5 to the sheet discharge rollers 7, there my be a risk that the transported original O is jammed. However, in this automatic document feeder, the jammed original can be removed easily. Referring to FIG. 4, a one-way clutch 23 is equipped between the shaft 21 to which pulleys 4 are fixed and a timing belt pulley 22, and a timing belt 25 for transmitting rotating drive force is trained over the pulley 22 and the timing belt pulley 24 on side of pair of the sheet discharge rollers.

Assume that the pulley 4 is rotated in the direction of the arrow in FIG. 1, the rotating drive force of the shaft 21 is transmitted to the pulley 22 through the one-way clutch 23. As a result, the pulley 24 is rotated through the belt 25 in the same direction as that of the pulley 4. In the thus constructed automatic document feeder, when the original O is transported and jammed in such a position as indicated in FIG. 1, and the jammed original O is removed, the pulley 22 runs idle, so that the jammed original O does not have any adverse effect on the drive system of the sheet transport belt 5. In other words, the jammed original O can be removed easily.

What is claimed is:

1. An opening and closing apparatus for opening and closing a swingable member, comprising:

a swingable member which is to be opened and closed with respect to a base member thereof, support means for supporting pivotally one end portion of said swingable member in a manner that said swingable member can be opened and closed with respect to said base member, spring means having one end fixed to a portion for supporting said swingable member pivotally, said spring means being adapted to be twisted forcibly in the closing direction of said swingable member, and transmission means for transmitting the resilient restoring force generated when said spring means is twisted in the closing direction of said swingable member to said swingable member during opening of said swingable member from its closed position, said transmission means being connected to said swingable member through a single arm extending in the vertical plane containing the center of gravity of said swingable member.

2. An opening and closing apparatus as in claim 1, wherein said spring means comprises a plurality of plate springs.

3. An opening and closing apparatus as in claim 1, wherein said spring means comprises a plurality of plate springs whose number can be changed for adjusting the resilient restoring force of said spring means.

4. An opening and closing apparatus as in claim 1, wherein said spring means comprises a coil spring.

5. An opening and closing apparatus as in claim 1, wherein said transmission means comprises a first member substantially fixed to said spring means and extending in the same direction as that of said spring means, said single arm being substantially fixed to said first member.

6. An opening and closing apparatus as in claim 5, wherein said first member comprises a support cylinder into which said spring means is fitted tightly, and a collar fixed to said support cylinder.

* * * * *